US009758735B2

(12) United States Patent
Meyer

(10) Patent No.: US 9,758,735 B2
(45) Date of Patent: Sep. 12, 2017

(54) CRUDE OIL STABILIZATION AND RECOVERY

(71) Applicant: Aspen Engineering Services, LLC, Golden, CO (US)

(72) Inventor: James M. Meyer, Golden, CO (US)

(73) Assignee: ASPEN ENGINEERING SERVICES, LLC, Golden, CO (US)

( * ) Notice: Subject to any disclaimer, the term of this patent is extended or adjusted under 35 U.S.C. 154(b) by 278 days.

(21) Appl. No.: 14/663,064

(22) Filed: Mar. 19, 2015

(65) Prior Publication Data

US 2015/0267129 A1 Sep. 24, 2015

Related U.S. Application Data

(60) Provisional application No. 61/955,555, filed on Mar. 19, 2014.

(51) Int. Cl.
*C10G 53/02* (2006.01)
*C10G 7/02* (2006.01)

(52) U.S. Cl.
CPC ..... *C10G 53/02* (2013.01); *C10G 7/02* (2013.01)

(58) Field of Classification Search
CPC ..... C10G 53/02; C10G 7/02
See application file for complete search history.

(56) References Cited

U.S. PATENT DOCUMENTS 7,350,581 B2 4/2008 Wynn

FOREIGN PATENT DOCUMENTS

EP 0213791 A2 3/1987
WO WO 98/17941 A1 4/1998

*Primary Examiner* — Randy Boyer
*Assistant Examiner* — Juan Valencia
(74) *Attorney, Agent, or Firm* — Thorpe North & Western, LLP.

(57) ABSTRACT

Volatile organic compounds are removed from crude oil by adding an amount of stabilization energy to crude oil upstream of, or directly into, a crude oil stock storage tank or by recovering and condensing vapors from tank vent gas. Produced gas may be recovered as NGL in one or more cooling stages. Produced gas, whether partially recovered or not, may be used as fuel for the heater treater, other combustion device or compressed into a pipeline.

20 Claims, 6 Drawing Sheets

CRUDE OIL STABILIZATION AND RECOVERY

RELATED APPLICATION

This application claims priority to and incorporates by reference U.S. Provisional Patent Application No. 61/955,555, filed Mar. 19, 2014 and having the same inventor as the present application.

FIELD OF INVENTION

This invention relates generally to hydrocarbon recovery from crude oil storage tanks.

BACKGROUND

Volatile emissions from crude oil in stock oil tanks is regulated by the Environmental Protection Agency's New Source Performance Standards (NSPS, 40 CFR Part 60 Subpart OOOO dated Aug. 16, 2012). The NSPS applies to storage tanks used in oil or natural gas production with the purpose of reducing toxic air pollutants and Volatile Organic Compound (VOC) emissions. Concurrently, recent reports indicate that crude oil from new shale plays have become a transportation safety risk. The concern is that the high volatility, measured by the Reid Vapor Pressure (RVP), from the Bakken Shale formation in North Dakota and the Eagle Ford Shale formation in Texas had RVP readings over eight pounds per square inch (PSI), and that some wells were producing oil with RVP readings as high as 12 PSI. A series of recent volatile crude oil railcar accidents have resulted in fires and deaths. Volatility risk also increases when crude oil is produced in a cold climate, and then shipped to a warm climate, because crude oil volatility increases exponentially with temperature. Consequently, oil and transportation industries are seeking solutions to reduce crude oil volatility and storage tank emissions.

Crude oil from a wellhead separator contains a copious amount of emulsified water at a pressure of 30 to 70 pounds per square inch gauge. The crude oil is sent to a heater-treater to break the oil and water emulsion. The separated crude oil is subsequently delivered to a stock oil storage tank, operated at ambient pressure. The transfer of crude oil from a hot, pressurized heater-treater to the ambient storage tank causes a substantial amount of VOC to vaporize as fugitive emissions. The NSPS regulation requires recovery of the VOC if emissions exceed 6 tons per year. The fugitive emissions contain a substantial amount of natural gas liquid (NGL) and natural gasoline. A Vapor Recovery Tower (VRT) upstream of the storage tanks may be used to separate the VOC from the crude oil. The VOC may be either burned or recovered in a vapor recovery unit (VRU). Vapor recovery units simply collect hydrocarbons from the vapor recovery tower, then compress the gas for transfer to a natural gas pipeline. However, about one-third of the wells in North Dakota are not connected to a pipeline. In such cases, the crude oil is transferred from the storage tanks to a transport tank (e.g. railcar tanks, tanker trucks, etc). For the wells that are connected to a pipeline, valuable hydrocarbons are sold at a discount when blended with natural gas.

A conventional oilfield operation is depicted in FIG. 1. Oil 1 from one or more local wells is collected into a gathering system (i.e. a matrix of rock crude oil collection pipes) and fed into separation vessel 2 where gas 3 flows from the top, water 5 flows from the bottom, and oil 4 from the side flows into heater-treater 6. Heater-treater 6 breaks the oil water emulsion and further separates oil and water. Vapor 7 from heater-treater 6 flows to flare 13. Water 9 flows from heater-treater 6 to water storage tank 10. Oil 8 is decanted from heater-treater 6, and then flows into oil storage tank 11. Oil storage tank 11 vents volatile organic compounds 12.

To conform to the new NSPS regulation, producers are inserting a Vapor Recovery Tower (VRT) 15 upstream of the crude oil storage tank 17 as depicted in FIG. 2. Oil 14 from the heater treater flows into VRT 15 where gas and oil are separated. Oil 16 from VRT 15 flows into crude oil storage tank 17. Gas from VRT 15 flows to a flare or combustion device 20. Alternatively, gas from VRT 15 may also be compressed into a pipeline. The crude oil tank vent 18 from crude oil tank 17 flows into VRT 15.

SUMMARY OF THE INVENTION

A new process of crude oil stabilization and recovery (COSR) at a wellhead is capable of reducing the crude oil volatility while enabling simpler compliance with the New Source Performance Standard. In this process, crude oil is stabilized by adding stabilization energy into crude oil and/or by recovering and condensing vapors from tank vent gas. Concurrently, pressure may be reduced in the heater-treater to facilitate hydrocarbon vaporization. The stabilization energy for the crude oil may be added directly to the heater-treater, the vapor recovery tower, the storage tank or in a heater added to interconnecting piping between these units. Volatile components are flashed from the crude oil to reduce the vapor pressure of the crude oil.

The gas that vaporizes from the crude oil may be cooled with the resulting gas, NGL and water separated. The separated gas may be compressed and cooled with the resulting gas, NGL and water separated a second time. The resulting gas whether there is no cooling, single cooling, or double cooling may be consumed in the heater treater, another combustion device or delivered to a pipeline.

There has thus been outlined, rather broadly, several features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
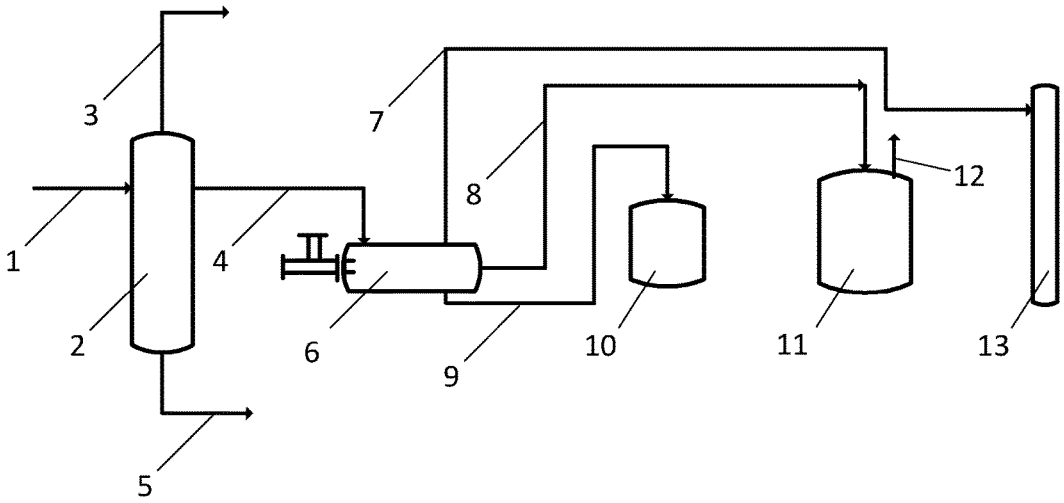
FIG. 1 is a process flow diagram for conventional oilfield equipment in accordance with the prior art.
Figure 2:
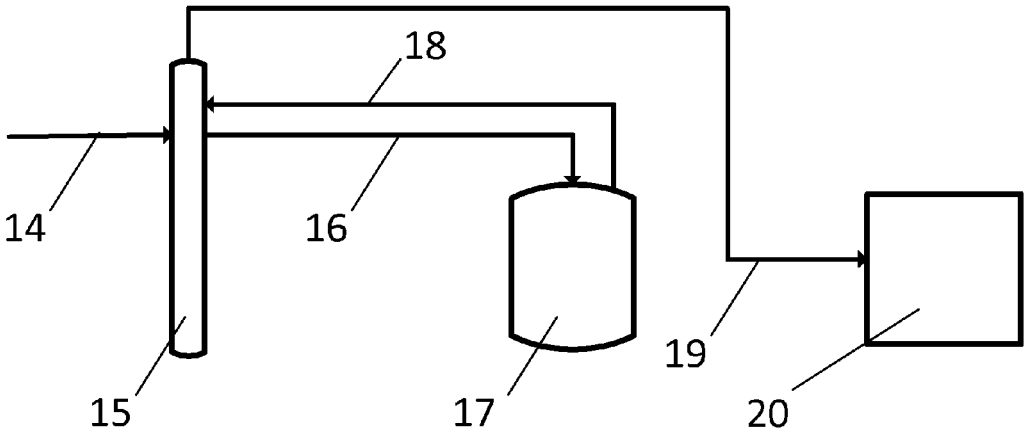
FIG. 2 is a process flow diagram for modified oilfield equipment to comply with the NSPS regulation in accordance with the prior art.

Embodiments of crude oil stabilization and recovery systems according to the present invention utilize stabilization energy added upstream of, or inside, the crude oil storage tank at a wellhead. The stabilization energy vaporizes volatile components, thereby reducing the crude oil volatility. More specifically, raw emulsified crude oil recovered from a well can be sent to a conventional wellhead separator which separates emulsified crude oil from rock and other materials. The emulsified crude oil can then be directed to a heater-treater which is operated to break the emulsion and form a crude oil and a water product. Although water content can vary depending on temperature (e.g. upwards of 20 mole %), a de-emulsified crude oil can typically have less than 2 mole %, and often less than 1 mole % water. The stabilization energy can be added sufficient to further remove VOC and other fugitive vapors from the crude oil to form a stabilized crude oil.

The vaporized components can be cooled by a first air cooler, and the resulting gas, NGL and water flow into a first three-phase separator where gas, NGL and water are separated. Where further NGL recovery is desired, the gas from the first three-phase separator is compressed. The compressed gas is sent to a second air cooler where partial condensation of liquids occurs. The resulting gas, NGL and water are collected in a second three-phase separator. The secondary three-phase separator separates the gas, NGL and water into separate streams. Alternatively, the compressed gas from the primary separator may be sent to a pipeline or simply combusted. When the compressed gas is coupled with a second stage of cooling, then the NGL streams from the primary and the secondary separator are combined for storage, transport and sale.

If the crude oil volatility meets regulatory requirements, then vapor from the heater treater and/or crude oil tank may be compressed and delivered to the heater-treater or other combustion device for fuel.

The crude oil stabilization and recover system can be fluidly connected to a wellhead separator and/or wellhead. Thus, the system is designed to produce a stabilized crude oil for storage in a stock oil storage tank at the wellhead. Crude oil from this stock oil storage tank can be transported to a refinery through a long-distance pipeline and/or delivered into a transport tank (e.g. railcar or tanker). Accordingly, in some cases the crude oil stabilization and recovery system is fluidly isolated from a refinery. In other cases, the crude oil stabilization and recovery system can be fluidly connected only through a long-distance pipeline of greater than 0.25 miles, and most often greater than 50 miles. Accordingly, a pipeline distance between the heater-treater and the stock oil storage tank can be less than 0.25 miles, and most often less than about 300 yards.

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment”, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The term “stabilized crude oil” means crude oil with a vapor pressure low enough to comply with transport and storage regulations, which is currently 13.7 psia for transportation and 11.1 psia for storage in floating roof tanks at 70° F.

The term “single-stage cooling” means that the tank vent vapors are only cooled once during the process and within the system.

The term “two-stage cooling” means that the tank vent vapors are cooled twice successively in either a partitioned cooler or two separate coolers.

The term “stabilization energy” means energy added to crude oil exceeding the energy requirement for separating oil and water in the heater-treater.

The term “partitioned section” refers to a section of a heat exchanger with a barrier to prevent mixing of fluids flowing through said heat exchanger.

The term “volatility” refers to the Reid Vapor Pressure of a liquid.

The term “three-phase separator” refers to a vessel capable of separating a gas phase, hydrocarbon phase and aqueous phase into dedicated outlets.

The term “two-phase separator” refers to a vessel capable of separating a gas phase from a liquid phase into dedicated outlets.

The term “blower” refers to a device that produces a current of air at a low differential pressure using a centrifugal pump or fan blades. Typically, a low differential pressure include pressure differences less than about 25 psi.

The term “compressor” refers to a high differential pressure gas compression devices, including screw compressors, scroll compressors and reciprocal compressors. Typically, high differential pressure includes a pressure difference of at least 25 psi.

The term “NGL” refers to hydrocarbon liquid condensed from the air cooler.

The term “scrubber” refers to a two-phase separator.

A First Embodiment Crude Oil Stabilization and Recovery System

Figure 3:
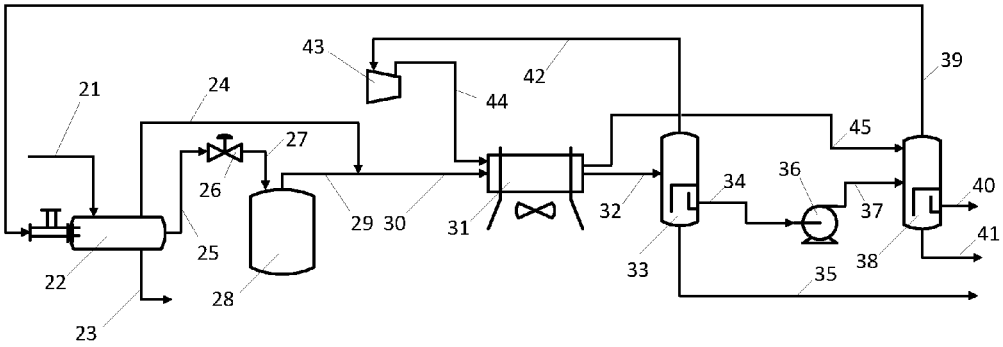
FIG. 3 is a process flow diagram for a COSR system with two-stage cooling in accordance with an example of the present invention.

FIG. 3 depicts a first embodiment of the COSR process. Crude oil 21 flows into heater-treater 22 where stabilization energy is added to vaporize volatile hydrocarbons and reduce the remaining crude oil volatility. Water 23 is decanted from the bottom of heater-treater 22, and stabilized crude oil 25 is depressurized through valve 26. A two-phase vapor/liquid stream 27 flows into storage tank 28, where gas separates from the crude oil. The gas 29 from storage tank 28 is mixed with gas 24 from heater treater 22 forming stream 30, which then flows into partitioned air cooler 31 where partial condensation occurs. The cooled stream 32 from air cooler 31 flows into three-phase separator 33. Gas, NGL and water are all separated in three-phase separator 33. Water 35 is removed from the bottom of separator 33. NGL 34 from separator 33 flows through pump 36. Stream 37 from pump 36 flows into separator 38 where gas, NGL and water are all separated. Gas 42 from separator 33 is compressed in compressor 43. The compressed gas 44 is partially condensed in partitioned air cooler 31 for a second time. The compressed, partially condensed vapor-liquid mixture 45 flows into three-phase separator 38. The gas 39 from the three-phase separator 38 is consumed as fuel for heater-treater 22, combusted in other devices, or delivered to a pipeline. Final traces of water 41 are removed from the bottom of three-phase separator 38. The combined NGL 40 from both cooling steps is removed from three-phase separator 38.

A Second Embodiment Crude Oil Stabilization and Recovery System

Figure 4:
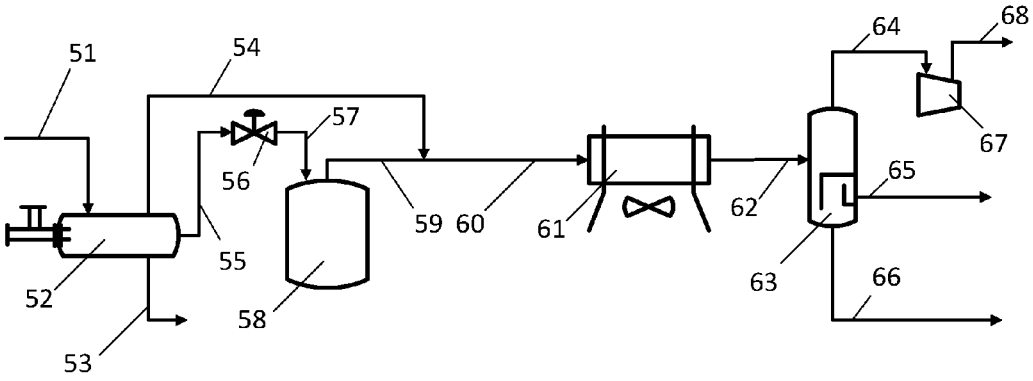
FIG. 4 is a process flow diagram for a COSR system with single-stage cooling in accordance with an example of the present invention.

FIG. 4 depicts a second embodiment of the COSR process. Crude oil 51 flows into heater-treater 52 where stabilization energy is added to vaporize volatile hydrocarbons and reduce the remaining crude oil volatility. Water 53 is decanted from the bottom of heater-treater 52, and stabilized crude oil 55 is depressurized through valve 56. A two-phase vapor/liquid stream 57 flows into storage tank 58, where gas separates from the crude oil. The gas 59 from storage tank 58 is mixed with gas 54 from heater treater 52 forming stream 60, which then flows into partitioned air cooler 61 where partial condensation occurs. The cooled stream 62 from air cooler 61 flows into three-phase separator 63. Gas, NGL and water are all separated in three-phase separator 63. NGL 65 flows from separator 63. Gas 64 from separator 63 is compressed in compressor 67. The compressed gas 67 is used for fuel or delivered to a pipeline. Traces of water 66 are removed from the bottom of three-phase separator 38.

A Third Embodiment Crude Oil Stabilization and Recovery System

Figure 5:
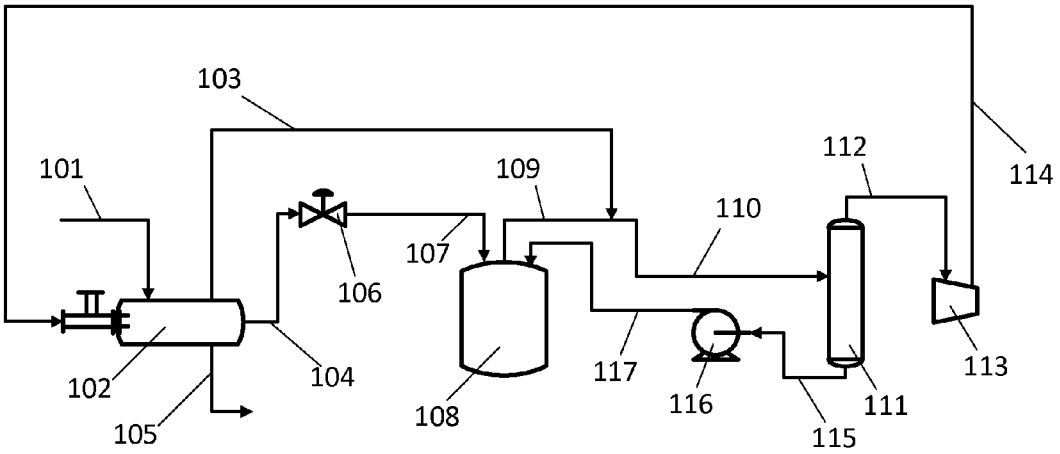
FIG. 5 is a process flow diagram for a COSR system without cooling in accordance with an example of the present invention.

FIG. 5 depicts a third embodiment of the COSR process. Volatile crude oil 101 flows into heater-treater 102 where stabilization energy is added to vaporize volatile hydrocarbons and reduce the remaining crude oil volatility. Water 105 is decanted from the bottom of heater-treater 102, and stabilized crude oil 104 is depressurized through valve 106. The depressurize gas 107 from valve 106 flows into storage tank 108, where volatile vapors separate from the crude oil. Gas 103 from heater-treater 102 is combined with stream 109 to form stream 110. Stream 110 flows into scrubber 111. The gas 112 from scrubber 111 is compressed in compressor 113. The gas 114 from compressor 113 is consumed as fuel in heater treater 102, another combustion device or delivered to a pipeline. Liquid 115 from scrubber 111 is pumped via pump 116. Stream 117 from pump 116 returns to crude oil tank 108.

A Fourth Embodiment Crude Oil Stabilization and Recovery System

Figure 6:
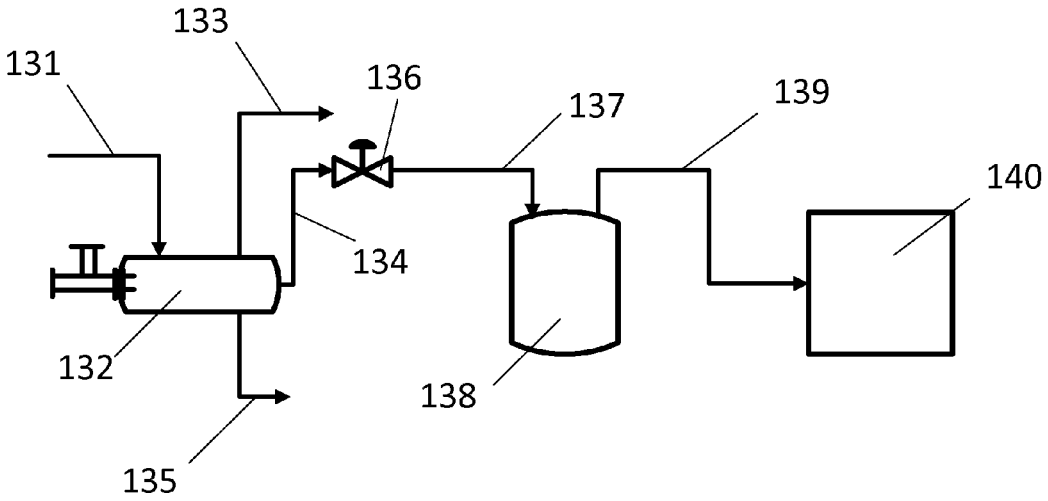
FIG. 6 is a process flow diagram for a COSR system without compression or cooling in accordance with an example of the present invention.

FIG. 6 depicts a fourth embodiment of the COSR process. Volatile crude oil 131 flows into heater-treater 132. Stabilization energy is added to heater treater 132 where volatile vapors 133 separate from the crude oil 134. Water 135 is decanted from the bottom of heater-treater 132. Crude oil 134 is depressurized through valve 136 resulting in a two-phase gas/liquid stream 137 flowing into storage tank 138. The gas 139 from storage tank 138 is delivered to a combustion device 140.

Alternative Embodiments and Variations

The various embodiments and variations thereof, illustrated in the accompanying figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

For instance, for some embodiments, stabilization energy is added between the heater-treater and the crude oil tank (i.e. 28, 58, 108, and 138). This can be accomplished using a stabilization energy heat source which is operatively connected to the heater-treater, the crude oil tank, or between these units. In some embodiments, stabilization energy is added directly to the crude oil storage tank. The stabilization energy heat source can be any unit or device which provides the stabilization energy to the crude oil. Although various energy sources can be used, non-limiting examples of suitable energy sources can include heat (e.g. recovered process heat, combustion heat, resistive electrical heating, and the like), acoustic energy (e.g. ultrasound and the like), or other suitable energy sources. Although the exact amount of stabilization energy may vary depending on the application, as a general guideline the stabilization energy can be from about 2,000 to 21,000 BTU per barrel, and in some cases, 7,000 to 13,000 BTU per barrel such as about 10,000 BTU per barrel of oil. Typically, the stabilization energy can heat the crude oil to 125 to 200° F. In one specific example, the stabilization energy source can be the heat source of the heater-treater which is operated at conditions above conventional conditions to break the emulsion. For example, typically the heater-treater can be operated at temperatures of 80 to 120° F. The stabilization energy can be imparted to the crude oil by heating the crude oil within the heater-treater, to raise the crude oil temperature by 10° F. or more, and in some cases by up to 80° F. Regardless of the specific avenue used to impart the stabilization energy, the net effect can be to drive vapor equilibrium sufficient to remove at least 35%, and in many cases at least 90% of the VOC in a controlled condition which can be stored, combusted or otherwise handled, thus reducing or eliminating undesirable residual VOC emissions during storage and transport. More specifically, an enthalpy of unstabilized crude oil prior to exposure to the stabilization energy can be lower than an enthalpy of the stabilized crude oil plus any produced vapor. The resulting stabilized crude oil can often have a vapor pressure less than about 13 psia, and in some cases less than about 4 psia at 100° F.

In some embodiments, the stabilization energy can be optional. For example, some raw crude oil may have a low VOC content (i.e. about 10 psia or lower) after standard heater-treater processing. In such cases, the addition of supplemental stabilization energy can be optional. Accordingly, the above recited embodiments can be implemented without the addition of the stabilization energy source. Thus, in accordance with these embodiments, the crude oil can be also be stabilized by recovering and condensing vapors from tank vent gas as described herein.

Some embodiments may not combine the heater-treater gas with the tank vent gas. Other embodiments may use two air coolers instead of a partitioned air cooler. Optionally, the heater treater gas may be combined with gas from the primary oil well separator and sent to a flare(s) and NGL recovery unit. Gas from the heater-treater is very rich. Consequently, recovery of the combined vent gas from the crude oil tank in the heater treater is improved because of the higher content of less volatile hydrocarbons. Some embodiments may substitute a two-phase separator where a three-phase separator is indicated, whereby water is separated from the NGL downstream of the COSR unit if necessary. Some embodiments may return all or part of the NGL to the crude oil storage tank. A VRT may be added oriented upstream of the crude oil tank, whereby gas from the VRT flows into the partitioned air cooler.

I claim:

1. A crude oil stabilization and recovery system comprising:

a heater-treater having a crude oil inlet fluidly connected to a wellhead separator and a heater-treater crude oil outlet;

a crude oil tank disposed downstream of the heater-treater;

a depressurization valve disposed downstream of the heater-treater crude oil outlet and upstream of the crude oil tank;

an air cooler disposed downstream of said crude oil tank; and a separator disposed downstream of the air cooler and adapted to separate gas and at least one of NGL and water, wherein the air cooler is a partitioned air cooler having a first section, and the system further comprising a compressor disposed downstream of said separator delivering compressed gas to a second partitioned section of said partitioned air cooler.

2. A crude oil stabilization and recovery system of claim 1, a stabilization energy source operatively connected to introduce a stabilization energy to the crude oil to form a stabilized crude oil.

3. A crude oil stabilization and recovery system of claim 1, wherein the separator is a primary three-phase separator and the system further comprises a second three-phase separator disposed downstream of said second partitioned section of said air cooler, wherein stabilized crude oil flows into said crude oil tank and NGL stabilized for storage and transport is withdrawn from said second three-phase separator.

4. A crude oil stabilization and recovery system of claim 1, wherein said compressor is disposed between the crude oil tank and the air cooler.

5. A crude oil stabilization and recovery system of claim 3, wherein NGL from the primary separator does not flow into the secondary separator.

6. A crude oil stabilization and recovery system of claim 1, wherein said heater-treater includes a heater-treater gas outlet and the crude oil tank includes a tank gas outlet and gas from said heater-treater is not mixed with gas from said crude oil tank.

7. A crude oil stabilization and recovery system of claim 1, further comprising a blower disposed downstream of said crude oil tank.

8. A crude oil stabilization and recovery system of claim 2, wherein the stabilization energy source is operatively connected to at least one of the heater-treater, the crude oil tank, and a separate unit oriented between the heater-treater and the crude oil tank.

9. A crude oil stabilization and recovery system of claim 1, wherein the air cooler includes two separate air coolers oriented downstream of the crude oil tank.

10. A crude oil stabilization and recovery system of claim 1, wherein the separator is at least one two-phase separator oriented downstream of the crude oil tank.

11. A crude oil stabilization and recovery system of claim 1, further comprising a compressor disposed downstream of said separator for compressing gas to a pipeline or a blower for compressing gas to a combustion device.

12. A crude oil stabilization and recovery system of claim 1, further comprising a combustion device disposed downstream of the crude oil tank.

13. A crude oil stabilization and recovery system of claim 1, wherein the crude oil tank is disposed downstream of the heater-treater a distance less than 0.25 miles.

14. A crude oil stabilization and recovery system of claim 2, wherein the stabilization energy is from 8,000 to 15,000 BTU.

15. A crude oil stabilization and recovery system of claim 2, wherein the stabilized crude oil has a vapor pressure less than 13 psia.

16. A crude oil stabilization and recovery system comprising:

a heater-treater having a crude oil inlet fluidly connected to a wellhead separator and a heater-treater crude oil outlet;

a crude oil tank disposed downstream of the heater-treater;

a depressurization valve disposed downstream of the heater-treater crude oil outlet and upstream of the crude oil tank;

a scrubber disposed downstream of said crude oil tank and said heater-treater;

a compressor disposed downstream of said scrubber adapted to compress a combined gas from said heater treater and the crude oil tank; and a pump disposed downstream of said scrubber and upstream of said crude oil storage tank, wherein stabilized crude oil flows into said crude oil tank.

17. A crude oil stabilization and recovery system of claim 16, where said compressor is a blower for compressing gas to a combustion device.

18. A crude oil stabilization and recovery system comprising:

a heater-treater having a crude oil inlet fluidly connected to a wellhead separator and a heater-treater crude oil outlet;

a crude oil tank disposed downstream of the heater-treater;

an air cooler disposed downstream of said crude oil tank;

a separator disposed downstream of the air cooler and adapted to separate gas and at least one of NGL and water;

a blower disposed downstream of said crude oil tank; and a combustion device disposed downstream of the crude oil tank, wherein stabilized crude oil flows into said crude oil tank.

19. A crude oil stabilization and recovery system of claim 18, further comprising a depressurization valve disposed downstream of the heater-treater crude oil outlet and upstream of the crude oil tank.

20. A crude oil stabilization and recovery system of claim 1, wherein said heater-treater includes a heater-treater gas outlet and the crude oil tank includes a tank gas outlet and gas from said heater-treater is mixed with gas from said crude oil tank.

* * * * *